United States Patent [19]

Amron

[11] 4,022,350

[45] May 10, 1977

[54] WATER GUN

[76] Inventor: Alan B. Amron, 70 Hofstra Drive, Plainview, N.Y. 11803

[22] Filed: July 8, 1976

[21] Appl. No.: 703,315

Related U.S. Application Data

[63] Continuation-in-part of Ser. No. 630,259, Nov. 10, 1975, abandoned.

[52] U.S. Cl. ..... 222/79; 222/333

[51] Int. Cl.[2] ..... A63H 3/18

[58] Field of Search ..... 222/79, 333, 383; 239/332, 587

[56] References Cited

UNITED STATES PATENTS

| | | | |
|---|---|---|---|
| 2,285,292 | 6/1942 | Mangels | 222/79 |
| 3,374,708 | 3/1968 | Wall | 222/79 X |
| 3,901,449 | 8/1975 | Bochmann | 239/332 |

*Primary Examiner*—Stanley H. Tollberg
*Attorney, Agent, or Firm*—Charles Marks

[57] ABSTRACT

A toy water gun is provided with a battery driven motor and pump assembled with a chamber communicating with a water reservoir and a nozzle in the gun. When the motor and pump are energized, intake and exit valves operate alternately to determine a series of spurts of water from the chamber through the nozzle.

3 Claims, 8 Drawing Figures

WATER GUN

BACKGROUND OF THE INVENTION

1. Field of the Invention

This application is a continuation-in-part of application's prior copending application Ser. No. 630,259 filed Nov. 10, 1975 and subsequently abandoned. This invention relates generally to toy water guns and is particularly concerned with electrically operated toy water guns.

2. DESCRIPTION OF THE PRIOR ART

Conventional toy water guns usually depend for their operation upon a trigger actuated mechanical pumping means and produce a continuous stream of water for a period of time corresponding with the actuation of the trigger and the level of pressure produced. Such guns, however, often rely upon a plurality of trigger actuations to accomplish a series of shots, i.e., spurts, of water therefrom and, when operated in this way, quickly tire the user.

The present invention solves these problems. Thus, it is an object of the present invention to provide an improved water gun which can be fired in a series of shots by one actuation of its trigger.

Another object of the invention is to provide such a water gun which is electrically operated and which will maintain a high water pressure over a substantial period of time.

Still another object of the invention is to provide such a water gun which incorporates a simple pump and valve means to accomplish its purposes.

Yet another object of the invention is to provide such a water gun which is of simple, economical and sturdy design.

Other and further objects of the invention will become apparent from the following description when read in conjunction with the accompanying drawing.

SUMMARY OF THE INVENTION

The present invention employs a housing in the form of a conventional pistol but having a reservoir accommodating a predetermined quantity of water. The housing includes a handle having a water-tight compartment accommodating one or more batteries actuated by a trigger whereby a switch may be cloased to energize a motor driven pump which is also located in the handle. The pump draws water from the reservoir into a chamber and then discharges the water therefrom through a nozzle in the barrel of the pistol. The intake of the water into the chamber is accomplished through a one-way entry valve and its discharge is accomplished through a pressure operated, one-way exit valve. When the chamber is full, the one-way valve is closed, thereby permitting discharge through the pressure operated one-way exit valve. With such discharge, however, the pressure in the chamber drops, thereby permitting the entry valve to open so as to draw more water into the chamber and thereafter close when the water pressure builds up to a point where the water may be discharged through the exit valve. The resulting series of spurts of water will continue as long as the trigger is actuated and the water supply in the reservoir remains.

In a modified form of the invention, the housing is in the form of a conventional, portable machine gun wherein the stock includes a water tight compartment communicating with a battery operated motor and pump assembly and valves in the vicinity of the handles of the gun to accomplish a series of spurts of water from the barrel thereof in the general manner previously described.

BRIEF DESCRIPTION OF THE DRAWINGS

In the drawings.

Throughout the various views, similar numerals are employed to refer to similar parts of the invention.

DESCRIPTION OF THE PREFERRED EMBODIMENT

Figure 1:
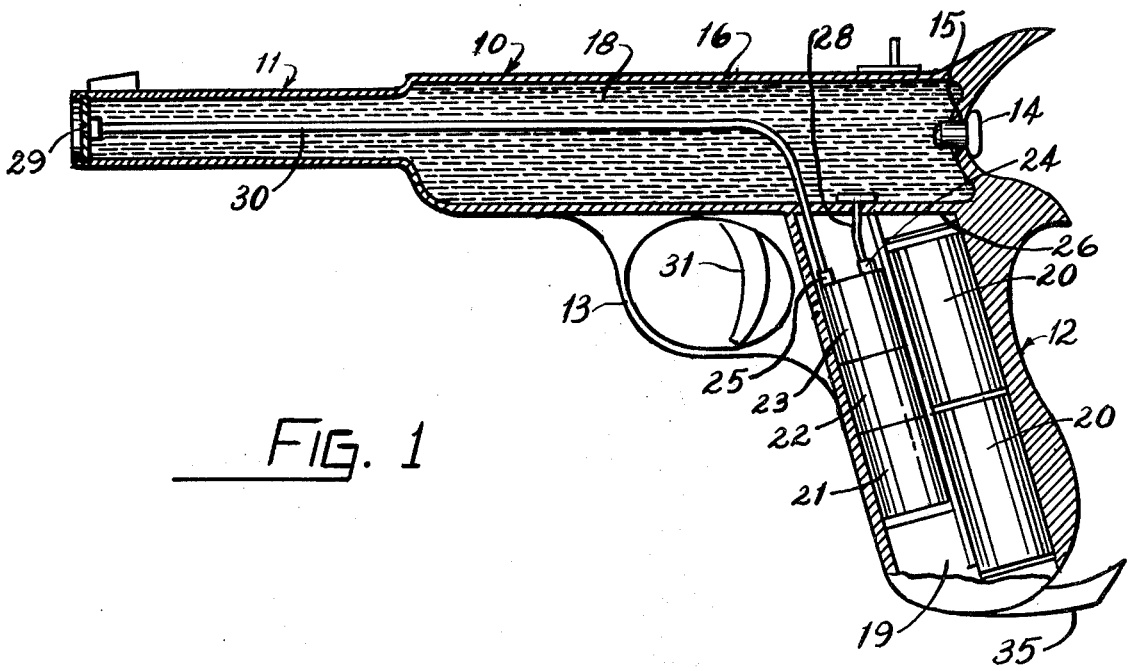
FIG. 1 is a cross-sectional, diagrammatic view of one embodiment of the invention.

As shown in FIG. 1 of the accompanying drawing, one embodiment of the present invention comprises a housing, generally designated by the numeral 10, having the external appearance of a pistol. The housing 10, includes a barrel 11, a handle 12 and a trigger guard 13. The barrel 11 is provided with a removable plug 14 engaged with an aperture 15 communicating with a reservoir 16 in the barrel 11 wherein a quantity of water 18 may be accommodated.

The handle 12 comprises a first chamber 19 accommodating energizing means such as one or more electrical batteries 20. Chamber 19 also accommodates a motor 21, a pump 22 and a second chamber 23 having a one-way intake valve 24 and a one-way exit valve 25. Chamber 19 is sealed against leakage from the reservoir 16 by a partition 26.

The intake valve 24 communicates with the reservoir 16 by means of a drain tube 28 which extends through the partition 26. The exit valve 25 communicates with a nozzle 29 by means of an exhaust tube 30 which also extends through the partition 26, the said nozzle 29 being seated in the mouth of the barrel 11.

Figure 2:
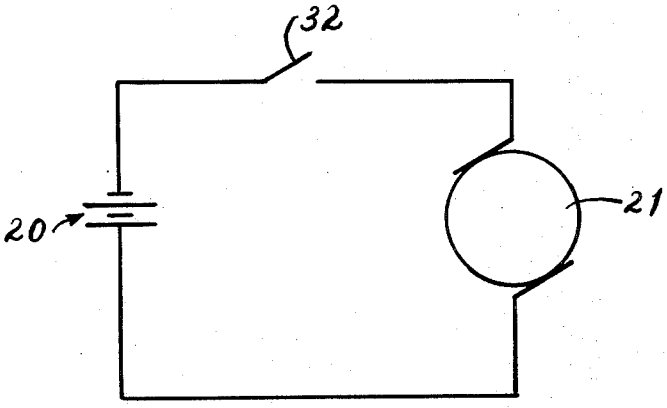
FIG. 2 is a circuit diagram of the electrical system employed in such embodiment of the invention.
Figure 3:
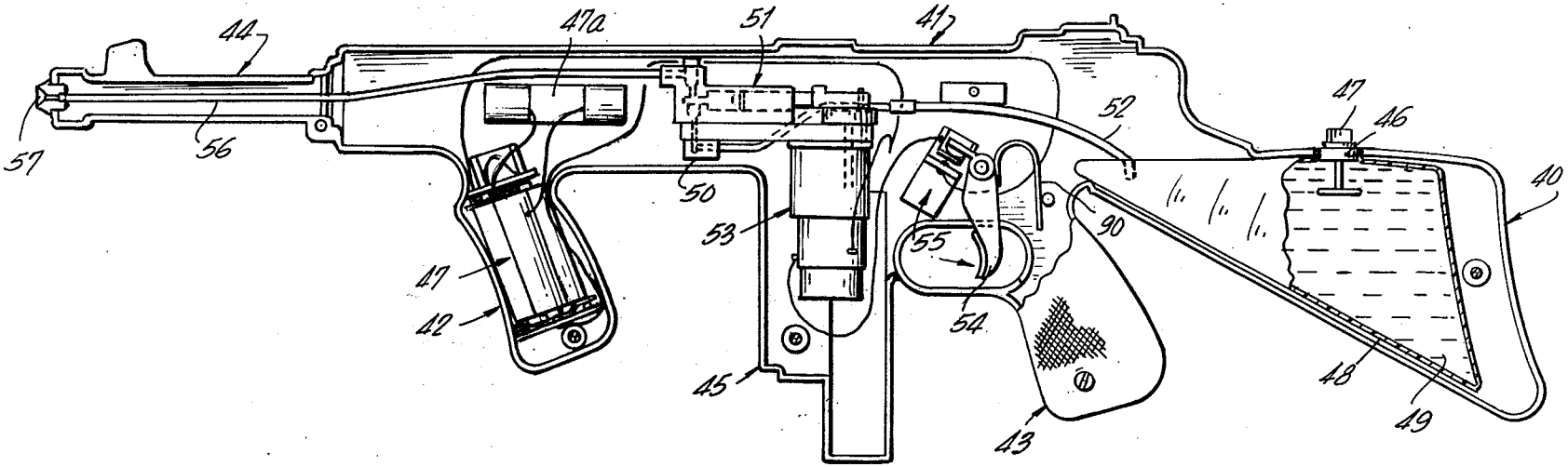
FIG. 3 is a modified form of the invention arranged as a machine gun.

A trigger 31 is provided within the trigger guard 13 and functions as a single pole single throw switch (not shown in FIG. 1) which is indicated diagrammatically by the numeral 32 in FIG. 2. When the trigger 31 is pulled, the switch 32 is closed, thereby permitting the batteries 20 to energize the motor 21 and actuate the pump 22. The electrical circuit involved is depicted in FIG. 2. Upon actuation of the pump 22, water is drawn from the reservoir 16 through the drain tube 28 and intake valve 24 into the chamber 23 where it is accumulated and then discharged through exit valve 25, exhaust tube 30 and nozzle 29.

An important feature of the invention resides in the fact that the water is discharged from the nozzle 29 in a series of spurts. This is accomplished by having the intake valve 24 and exit valve 25 permit alternate flow of water therethrough, such mode of operation being accomplished by means well known in the art. For example, the intake valve 24 may be in the form of a one-way valve and the exit valve 25 may be in the form of a spring-biased poppet valve. Thus, upon the operation of the pump 22, water may be drawn through the intake valve 24 until the chamber 23 is filled, during which time the exit valve 25 remains closed. Thereafter, upon continued operation of the pump 22, the water pressure within the chamber 19 increases so as to close the intake valve 24 and open the exit valve 25, thereby permitting discharge of a quantity of water until the pressure within the chamber 23 decreases so as to permit opening of the intake valve 24 and closing of the exit valve 25. Since the motor 21 operates at high speed and the pump 22 is geared down to permit a correspondingly substantial power, it will be seen that the spurts of water thus produced will emerge from the nozzle 29 with great rapidity, thereby simulating a series of "shots" from the pistol which will continue during the actuation of the trigger 31.

The foregoing description of the operation of the intake and exhaust valves of the chamber 23 is intended to be illustrative only. It is to be understood that other means, such as piston-operation may also be employed to accomplish similar results, such operation including intake and exhaust strokes of the piston in the chamber 23 so as to provide a series of spurts of water from the chamber 23 through the nozzle 29. This mode of operation may be more clearly understood from a consideration of the subsequently described modified form of the invention.

A closure member 35 is hingeably secured to the handle 12 so as to permit access to its interior when desired.

A modified form of the invention is depicted in FIG. 3 through 8. As may be seen in FIG. 3, this form of the invention has the external conformation of a machine gun and includes a shoulder stock 40, a body portion, generally designated by the numeral 41, front and rear handles, generally designated by the numerals 42, 43, a barrel, generally designated by the numeral 44, and an ammunition clip receptacle, generally designated by the numeral 45.

The shoulder stock 40 is provided with an aperture 46 accommodating a removable plug 47 communicating with a reservoir 48 within the shoulder stock 40, said reservoir 48 accommodating a quantity of water 49. The reservoir 48 communicates with a housing 50 of a valve and pump assembly, generally designated by the numeral 51, disposed within the body portion 41, said communication being by means of a tube 52 connected to said reservoir 48 and said housing 50. The valve and pump assembly 51 surmounts a cam and motor assembly, generally designated by the numeral 53, located within the ammunition clip receptacle 45 and energized by a suitable source of electricity such as batteries 47, disposed within the front handle 42 and activated by a trigger 54 and switch 55.

As hereafter indicated, when the cam and motor assembly 53 is energized, water is drawn from the reservoir 48 through the tube 52 into the valve and pump assembly 51, whence it is discharged through tube 56 and nozzle 57 in the barrel 54, such discharge being intermittent or in spurts of water.

Figure 4:
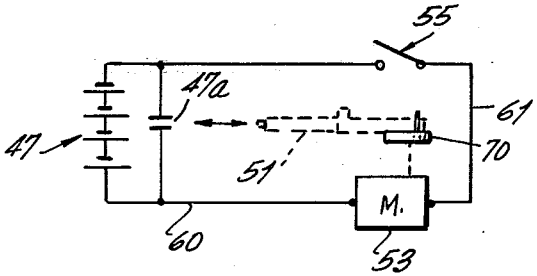
FIG. 4 is a circuit diagram of the electrical system employed in said modified form of the invention.

The electrical system involved is depicted diagrammatically in FIG. 4 and is similar to the electrical system employed in the first described embodiment of the invention. As indicated in FIG. 4, the electrical system includes the previously mentioned cam and motor assembly 53, batteries 47, a condenser **47*a* connected in parallel with the batteries 47, a switch 55, and conductors 60, 61, 62, the cam and motor assembly 53 being surmounted by the valve and pump assembly 51** depicted in broken lines.

The operation of the valve and pump assembly 51 may be better understood from a consideration of FIGS. 5, 6, 7 and 8. As may be seen in FIGS. 5 and 6, the motor **53*a* is provided with a shaft 53*b* extending through a plate 69 and connected to a circular cam 70 having an upright eccentric pin 71 slidably engaged with a slot 72 formed in a base plate 73 engaged with a reciprocable piston 74. The piston 74 is accommodated within a cylinder 75 in the valve and pump assembly 51. The aforementioned tube 52 communicates with an intake valve 80 within the housing 50, the said valve 80 being surmounted by an aperture 81 formed in the plate 69 and communicating between said valve 80 and a chamber 82. Valve 80 is provided with a one-way valve gate 80*a*. Said chamber 82 also communicates with a duct 83 extending from the interior 84 of the cylinder 75. The duct 83 also communicates through channel 85 with the chamber 86 of exit valve, generally designated by the numeral 86*a* and having a poppet member 86*b*. Chamber 86 communicates with the aforementioned tube 56**.

Figure 5:
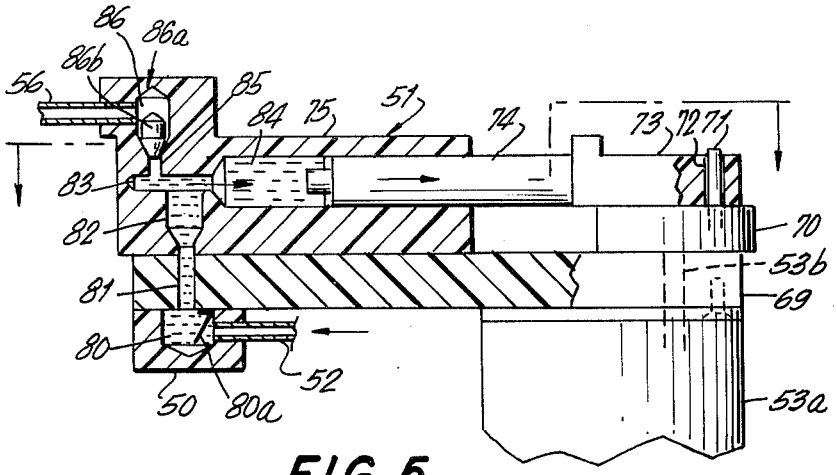
FIG. 5 is a fragmentary, cross-sectional view of the valve system employed in said modified form of the invention.
Figure 6:
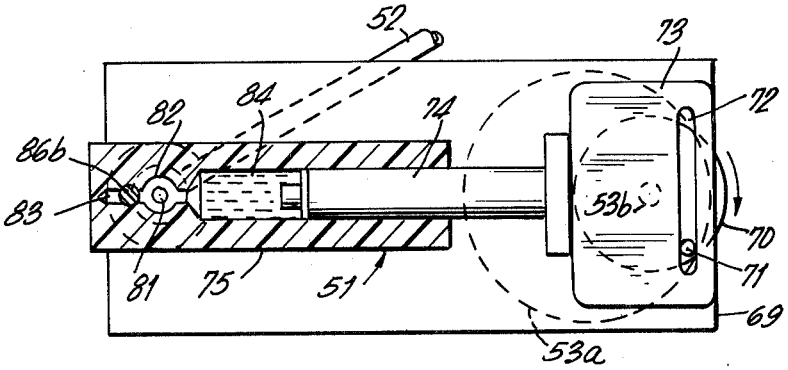
FIG. 6 is a view taken about the line 6—6 of FIG. 5.
Figure 7:
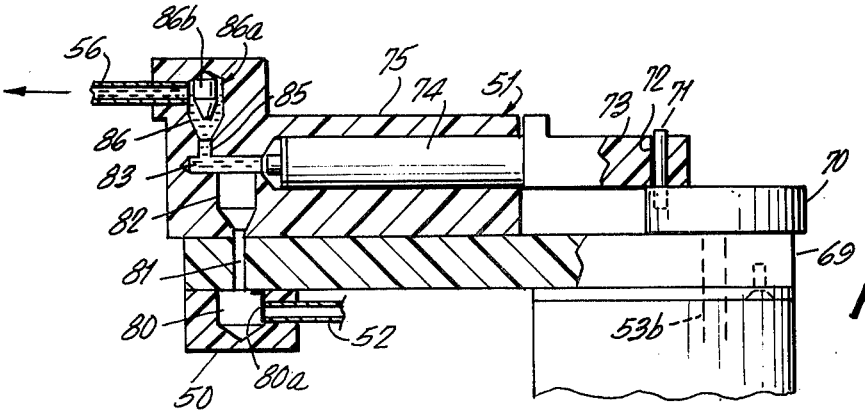
FIG. 7 is another fragmentary, cross-sectional view of the valve system employed in said modified form of the invention.
Figure 8:
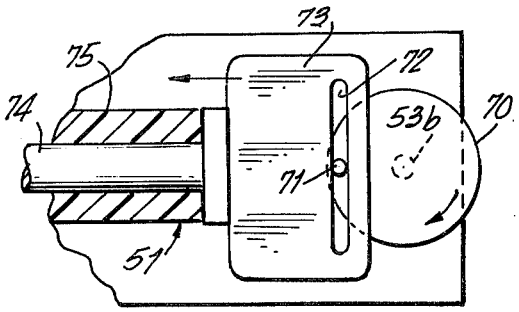
FIG. 8 is a view taken about the line 8—8 of FIG. 7.

It will be seen that when the switch 55 is closed by the trigger 54 so as to activate the motor **53*a*, the cam 70 is rotated, thereby causing the pin 71 to reciprocate the piston 74 within the cylinder 75 and alternately draw water from the reservoir 48 into the interior 84 of the cylinder 75 and discharge it through the tube 56 and nozzle 57 of the barrel 44. As shown in FIGS. 5 and 6, the piston 74 is disposed at the end of its intake stroke whereby water is drawn through tube 52, intake valve 80, chamber 82 and into the interior 84 of cylinder 75. Thereafter, with further rotation of the cam 70, as depicted in FIGS. 7 and 8, the piston 74 accomplishes its exhaust stroke whereby it is moved to the opposite end of the cylinder 75 so as to discharge the water in the interior 84 of the cylinder 75 through duct 83, channel 85, exit valve 86*a* and tube 56 connected to the nozzle 57 depicted in FIG. 3. During this exhaust stroke, valve gate 80*a* blocks return of the water to the reservoir depicted in FIG. 3. It is to be understood that valves 80 and 86*b* may comprise any of a variety of one-way or poppet valves of conventional design. Upon further rotation of the motor the piston 74 performs its intake stroke whereby it is returned to the position depicted in FIGS. 5 and 6** and is ready to begin its above described exhaust stroke again.

Thus, it will be seen that by means of this reciprocating movement of the piston 74, water is alternately drawn from the reservoir 48 and discharged through the nozzle 57, such discharge being interrupted by the said intake strokes so that the discharge is accomplished intermittently or in spurts rather than in a continuous stream.

It will also be observed that this effect is achieved during continuous pull of the trigger 54 whereby the switch 55 is closed, and does not require repeated or a series of pulls of the trigger 54. The trigger 54 is biased by a spring 90, so that when released, the trigger 54 opens the switch 55 and thereby terminates the intermittent discharge of water from the nozzle 57.

I claim:

1. In a toy water gun, the combination comprising:

a. a housing having the external appearance of a pistol and including a barrel, a handle and a trigger guard;
b. an aperture formed in said barrel;
c. the aperture being provided with a removable plug;
d. the barrel including a reservoir accommodating water introduced through said aperture;
e. the handle including a first chamber accommodating electrical means and water distribution means;
f. said water distribution means communicating with said reservoir and a nozzle provided in the barrel;
g. a trigger disposed within said trigger guard and including switch means;
h. said water distribution means including a motor, a pump and a second chamber;
i. said motor and pump being energized by said electrical means when said switch means is actuated by said trigger;
j. said second chamber being provided with intake and exit valves operating in sequence, whereby a series of spurts of water is drawn from the reservoir through the intake valve into the second chamber and dispensed therefrom through the exit valve and said nozzle when said motor and pump are energized;
k. said handle being provided with closure means.

2. In a device according to claim 1, a water-tight partition between said reservoir and said first chamber.

3. In a toy water gun having the external conformation of a machine gun including a shoulder stock, body portion, front and rear handles, a barrel and an ammunition clip receptacle, the combination comprising:
a. reservoir formed within said shoulder stock and adapted to accommodate a quantity of water;
b. an aperture formed in said shoulder stock and communicating with said reservoir;
c. a removable plug accommodated within said aperture;
d. reciprocable pump and valve means disposed within said body portion;
e. tubular means communicating between said reservoir and said reciprocable pump and poppet valve means;
f. tubular means communicating between said reciprocable pump and poppet valve means and a nozzle formed in said barrel.
g. electric battery means disposed within one of said handles;
h. a motor and cam assembly communicating with a reciprocable piston in said reciprocable pump and poppet valve means;
i. a spring-biased trigger disposed within said body portion and communicating with a switch;
j. said motor and cam assembly being energized by said electric battery means when said spring-biased trigger actuates said switch, thereby reciprocating said piston and drawing water from said reservoir through said poppet valve means and discharging it intermittently through said nozzle;
k. one-way valve means disposed between said reciprocable pump and poppet valve means and said reservoir.

* * * * *